US010919174B2

(12) United States Patent
Groneberg

(10) Patent No.: US 10,919,174 B2
(45) Date of Patent: Feb. 16, 2021

(54) DEVICE FOR CUTTING FOOD USING A LIQUID JET

(71) Applicant: Nienstedt GmbH, Haltern am See (DE)

(72) Inventor: Jan Groneberg, Berlin (DE)

(73) Assignee: Nienstedt GmbH, Haltern am See (DE)

( * ) Notice: Subject to any disclaimer, the term of this patent is extended or adjusted under 35 U.S.C. 154(b) by 211 days.

(21) Appl. No.: 15/770,821

(22) PCT Filed: Oct. 31, 2016

(86) PCT No.: PCT/DE2016/100512
§ 371 (c)(1),
(2) Date: Apr. 25, 2018

(87) PCT Pub. No.: WO2017/071697
PCT Pub. Date: May 4, 2017

(65) Prior Publication Data

US 2018/0304488 A1 Oct. 25, 2018

(30) Foreign Application Priority Data

Oct. 30, 2015 (DE) ..... 10 2015 118 610.1

(51) Int. Cl.
*B26F 3/00* (2006.01)

(52) U.S. Cl.
CPC ..... *B26F 3/008* (2013.01); *B26F 3/004* (2013.01); *B26F 2210/00* (2013.01)

(58) Field of Classification Search
CPC .. B26F 3/00; B26F 3/004; B26F 3/008; B26F 3/006; B24C 5/02; B24C 5/04; B24C 5/045
(Continued)

(56) References Cited

U.S. PATENT DOCUMENTS 4,669,229 A 6/1987 Ehlbeck
4,964,244 A 10/1990 Ehlbeck
(Continued)

FOREIGN PATENT DOCUMENTS

DE 10 2014 221276 A1 10/2015
EP 0389806 A1 10/1990
(Continued)

OTHER PUBLICATIONS

International Search Report and Written Opinion for PCT/DE2016/100512 dated Apr. 11, 2017 (with English translation; 12 pages).
(Continued)

*Primary Examiner* — Andrea L Wellington
*Assistant Examiner* — Richard D Crosby, Jr.
(74) *Attorney, Agent, or Firm* — Bejin Bieneman PLC

(57) ABSTRACT

A device for slicing foodstuffs by means of a liquid jet includes an advancing device for transporting the foodstuff in an advancing direction, said advancing device having a processing region on which the foodstuff bears and in which the liquid jet is directed onto the foodstuff, an exit nozzle, disposed in the region of the processing region, from which exit nozzle the liquid jet exits, wherein the processing region below the foodstuff has a jet passage opening for the liquid jet exiting from the foodstuff, and a jet receptacle for the liquid jet and the discharge of the latter is provided below the jet passage opening.

15 Claims, 4 Drawing Sheets

(58) Field of Classification Search
USPC ..... 83/177, 53
See application file for complete search history.

(56) References Cited

U.S. PATENT DOCUMENTS

| | | | | |
|---|---|---|---|---|
| 5,365,816 | A | 11/1994 | Rudy | |
| 5,782,673 | A * | 7/1998 | Warehime | B24C 1/045 451/2 |
| 6,001,219 | A * | 12/1999 | Caspar | B26F 3/004 162/286 |
| 6,098,512 | A * | 8/2000 | Life | B26D 3/10 83/286 |
| 6,299,510 | B1 * | 10/2001 | Massenburg | B24C 1/045 239/433 |
| 6,988,434 | B1 * | 1/2006 | Jiao | B23Q 1/4866 451/11 |
| 7,775,854 | B1 * | 8/2010 | Boman | B24B 55/12 451/8 |
| 7,829,036 | B2 * | 11/2010 | Kumar | B26D 7/08 422/179 |
| 7,934,977 | B2 * | 5/2011 | Hashish | B24C 1/045 451/102 |
| 9,003,936 | B2 * | 4/2015 | Chillman | B24C 1/045 83/168 |
| 9,108,297 | B2 * | 8/2015 | Schubert | B24C 1/045 |
| 9,469,495 | B2 * | 10/2016 | Caspar | B24C 1/045 |
| 9,884,406 | B2 * | 2/2018 | Hashish | B24C 7/0046 |
| 10,099,397 | B2 * | 10/2018 | Nordell | B26F 3/008 |
| 2003/0019723 | A1 * | 1/2003 | Rudy | B26D 7/20 198/493 |
| 2003/0040262 | A1 * | 2/2003 | Devine, II | B26F 1/26 451/40 |
| 2005/0032471 | A1 * | 2/2005 | Pfarr | B23K 26/0838 452/181 |
| 2005/0202764 | A1 * | 9/2005 | Tateiwa | B24C 7/0007 451/87 |
| 2006/0117924 | A1 * | 6/2006 | Pfarr | B26F 3/004 83/177 |
| 2010/0173570 | A1 * | 7/2010 | Reukers | B24C 1/045 451/91 |
| 2010/0180738 | A1 | 7/2010 | Tavger | |
| 2013/0306748 | A1 * | 11/2013 | Hashish | B26F 3/008 239/11 |
| 2014/0024295 | A1 * | 1/2014 | Hashish | B24C 5/02 451/38 |
| 2015/0118942 | A1 * | 4/2015 | Hashish | B24C 3/06 451/80 |
| 2015/0217305 | A1 * | 8/2015 | Yie | B24C 3/12 239/240 |
| 2016/0297036 | A1 * | 10/2016 | Schmauder | B23K 26/0869 |
| 2016/0325401 | A1 * | 11/2016 | Meyer | B24B 57/02 |
| 2017/0089328 | A1 * | 3/2017 | Sato | F04B 9/103 |
| 2018/0257253 | A1 * | 9/2018 | Vandergon | B26F 3/004 |
| 2018/0304488 | A1 * | 10/2018 | Groneberg | B26F 3/004 |
| 2020/0269386 | A1 * | 8/2020 | Echasserieau | B24C 5/04 |
| 2020/0306450 | A1 * | 10/2020 | Enderle | A61M 5/3007 |

FOREIGN PATENT DOCUMENTS

| | | | |
|---|---|---|---|
| EP | 1990144 | A2 | 11/2008 |
| JP | S62-015099 | U | 1/1987 |
| JP | H04-201200 | A | 7/1992 |
| JP | 3030172 | U | 10/1996 |
| WO | 2014160415 | A2 | 10/2014 |
| WO | 2015198062 | A1 | 12/2015 |

OTHER PUBLICATIONS

JPO Office Action for Application No. JP2018-522607 dated Sep. 2, 2020 (12 pages; with English translation).

* cited by examiner

Fig. 1
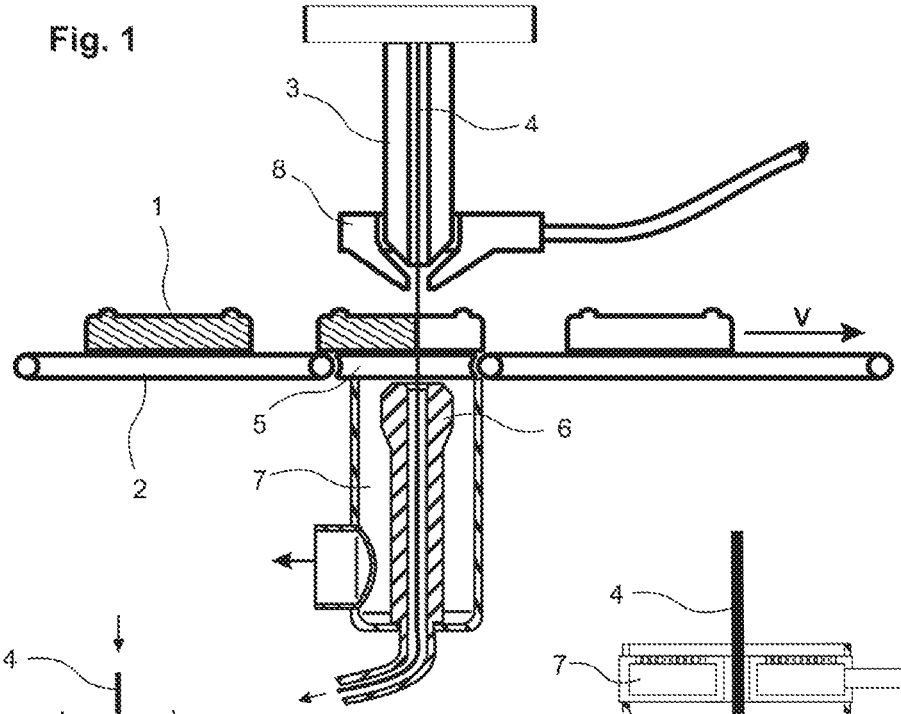
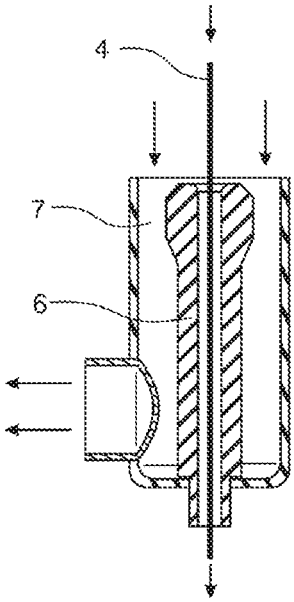
Fig. 2
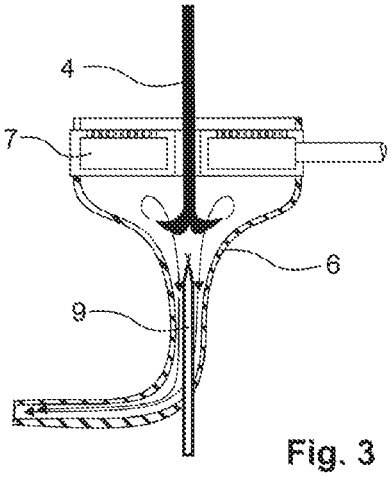
Fig. 3
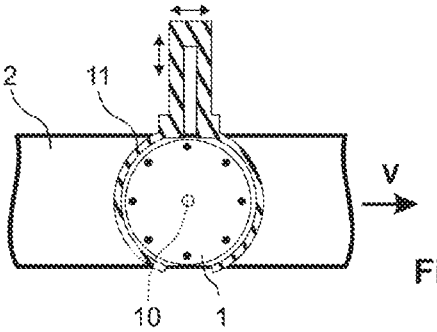
Fig. 4
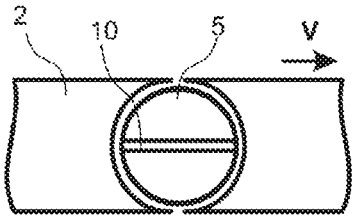
Fig. 5

DEVICE FOR CUTTING FOOD USING A LIQUID JET

CROSS-REFERENCE TO RELATED APPLICATIONS

This application is a national stage of, and claims priority to, Patent Cooperation Treaty Application No. PCT/DE2016/100512, filed on Oct. 31, 2016, which application claims priority to German Application No. DE 10 2015 118 610.1, filed on Oct. 30, 2015, which applications are each hereby incorporated herein by reference in their entireties.

BACKGROUND

Devices for slicing foodstuffs are known from EP 1 990 144 A2. In the case of the known devices, foodstuffs, in particular foodstuffs from dough, are cut by means of water-jet cutting. EP 1 990 144 A2 herein describes a device in which the foodstuff, configured as a cake, for example, is placed onto a conveyor belt, the position thereof then being optically detected and a desired cutting pattern being subsequently generated. The known cake slices, for example, are thus cut out. In order for the cuts to be incorporated, the exit nozzle having the water jet is repositioned transversely in relation to the advancing direction of the conveyor belt, such that, conjointly with the movement of the conveyor belt in the forward and reverse direction, the desired angle can be cut. A device known from U.S. Pat. No. 5,365,816 A also incorporates cuts in round foodstuffs such as, for example, cakes, in the same manner.

However, the disadvantage of these known devices for slicing foodstuffs lies in that the foodstuff can indeed be reliably cut, but that the support pad on which the foodstuff is guided through the device is damaged by the water jet as time progresses. A further disadvantage lies in that water and particles of the foodstuff can make their way into the environment on account of the high-pressure jet, this in addition to compromising the foodstuff and contaminating the device also potentially leading to pollution by way of germs in the case of the processing of foodstuffs.

A similar device in which the processing region below the foodstuff has a jet passage opening for the liquid jet exiting from the foodstuff and a jet receptacle into which the liquid jet enters in order for the cutting liquid to be collected and which has a discharge for the cutting liquid is disposed below the jet passage opening is known from WO 2015/198062A1.

This device has the advantage that the jet can be trapped such that the water or other kind of cutting medium can be discharged and recycled. Additionally, a stray spray of the cutting medium below the processing region can be reduced on account thereof.

However, this known device still has the disadvantage that particles which are entrained laterally beside the jet receptacle do not make their way into the jet receptacle. This is disadvantageous in particular in the context of the processing of non-homogeneous foodstuffs, since scatter effects which can release comparatively large quantities of the foodstuff on the lower side can arise here. Furthermore, foodstuff particles can adhere to the adjacent regions of the device on account thereof, this being potentially disadvantageous in particular in terms of hygiene and salmonella, for example.

SUMMARY

Disclosed herein is a device for slicing foodstuffs. The device, by way of at least one liquid jet, can slice foodstuffs which are transported by an advancing device in at least one advancing direction through the device having a processing region. The liquid jet is directed onto the foodstuff to be sliced when it is in the processing region. The cuts are then incorporated by way of an exit nozzle from which the pressurized, bundled liquid jet exits in the region of the processing region. Alternatively, the processing region having the foodstuff can also be locationally fixed and the exit nozzle can be repositioned by way of the device.

The device for slicing foodstuffs provides a reliable and, as far as possible, a wear-free functioning and simultaneously the lowest possible contamination and pollution of the environment.

A lower suction device is provided for particles entrained by the liquid jet and/or quantities of liquid which accumulate in particular on the jet passage opening or are separated from the liquid jet is provided below the jet passage opening.

Further, it is now also possible for a comparatively soft foodstuff which even in the frozen state in most instances requires a support face in order for a clean cut to become possible to be cut. A particular advantage on account of the lower suction device lies in that the negative pressure, which from the suction device also acts on the foodstuff, suctions the foodstuff tightly onto the processing region, the risk of any slippage of the foodstuff thus being able to be minimized. Particles which are released from the foodstuff laterally beside the liquid jet exiting the foodstuff are simultaneously suctioned. Finally, the suction device is also capable of suctioning quantities of liquid which are present either on the lower periphery of the cut or in the form of a finely atomized liquid below the foodstuff, on account of which the contamination of the environment, for example with salmonella, can be avoided on the one hand, and a softening of the foodstuff can be avoided, on the other hand.

In the application of the device, the foodstuff is usually cut in a frozen, preferably deep frozen, state. Deep frozen in the context of this application does not necessarily mean a temperature lower than minus 18° C.; temperatures of minus 10° C. or warmer are also to be understood as included in the use of that term herein. Ultimately, however, an optimization pertaining to temperatures and pressures of the liquid jet at which the best cutting result can be achieved is carried out, as will be discussed further below.

One aspect relates to catching the liquid jet exiting the foodstuff or the processing region, respectively, from below. The processing region of the device has a support face which below the liquid jet has a jet passage opening for the jet, on the one hand. The processing region can in principle be part of the advancing device, thus can be guided conjointly with the conveyor belt through the device. However, the processing region will preferably be configured so as to be stationary, such that the foodstuff is transferred by the advancing device to the processing region, and after processing is again transported onward by the advancing device. To this end, corresponding means which slide the foodstuff onto the stationary processing region and later slide said foodstuff onto the departing transport belt are provided.

One design embodiment of the advancement in the case of a stationary processing region has in each case one conveyor belt in front of and behind the processing region, wherein the front conveyor belt slides the foodstuff onto the processing region, while the rear conveyor belt then acquires the finished cut foodstuff and feeds the latter to further processing or packaging. In order for this transfer to be performed without any deformation of the foodstuff, the foodstuff can preferably be either positioned on a workpiece support or a realignment device can be provided which transfers the foodstuff from the front conveyor belt into the stationary processing region and subsequently onto the rear conveyor belt. Such a realignment device can be, for example, a gripper arm or a slider element. A gripper arm, for instance, can be disposed on the device so as to be operated hydraulically, pneumatically or by motive power.

A further possibility lies in that conveyor belts are provided on the external peripheries in the region of the processing region, said conveyor belts acquiring the foodstuff from the upstream conveyor belt and being able to transport said foodstuff into the processing region. In the same manner, the foodstuff, after having been cut, can be transferred by way of these conveyor belts to the downstream conveyor belt for further processing or packaging.

As is the case in the known water-jet cutting devices, the present device can be used in conjunction with water jets as a cutting tool. However, other liquid, potentially even gaseous, media can also be used. In particular, it can be helpful for the freezing point of the liquid cutting medium to be modified by adding salts or other additives. While the workpiece, thus the foodstuff, in the case of known water-jet cutting devices usually in borne on a grate, a support face which below the engagement point of the liquid jet has a jet passage opening through which the liquid jet after exiting the foodstuff can exit during the entire cutting path without any contact with the surrounding support face in the processing region is now preferably used.

It has indeed been demonstrated that specifically in the case of the processing of foodstuffs any contact of the liquid jet with a part of the processing region that is disposed therebelow entails unfavorable side-effects. On the one hand, part of the liquid jet on account of the counter bearing formed hereby is reflected back in the direction of the foodstuff, this in the case of soft foodstuffs potentially leading to a messy cutting edge on the lower side and to contamination of the foodstuff on account of the absorption of water.

It can furthermore arise that particles located in the foodstuff are conjointly with the liquid jet pushed downward through the cutting gap. This can be the case, for example with raspberries or strawberries in a cake, the seeds thereof then being expelled downward conjointly with the liquid jet. In as far as the possibility of a counter bearing, even if only by way of a narrow web of a grate on which the foodstuff is borne during cutting, is now provided below the exit of the liquid jet from the foodstuff, disturbances in the jet pattern can arise and the cutting pattern can thus be compromised.

In the context of the processing of foodstuffs, there is furthermore the problem area that the liquid jet as far as possible is not to remove any material of the processing region or other parts of the device. In as far as such a material removal does take place, it would otherwise have to be ensured that said removed material does not accumulate in the foodstuff. Such proof is often difficult to provide, so that any contact of the liquid jet with the processing region and with further parts of the device in the context of the cutting of foodstuffs is to be avoided as far as possible.

According to one aspect of the present invention, a jet passage opening which is sufficiently large in order for the jet to pass without any removal of material is therefore used. On account thereof, the jet below the foodstuff, optionally conjointly with exiting particles, can now enter the jet receptacle disposed there. This jet receptacle is constructed here in such a manner that said jet receptacle is capable of catching the jet without the negative effects described above arising.

The jet receptacle thus functions as a brake and as a suction unit for the liquid jet. This can be implemented in different ways. In the case of one potential design embodiment, the jet receptacle is configured in the form of a tube or duct and in geometric terms is designed and disposed such that, even when material was removed from the wall of said jet receptacle, such material with an adequate safety margin would no longer make its way upward to the foodstuff. However, a removal of material in the jet receptacle can also be avoided since the jet velocity and the jet focusing decrease as the distance from the exit nozzle increases.

On account of the lower suction device according to the present disclosure, not only the liquid particles but also particles and quantities of liquid that arise around the exiting jet can be suctioned. This not only has the already mentioned advantage that a softening of the foodstuff by drops adhering to the cutting edge can be avoided, this also being able to reduce or avoid discolorations of the base when the cutting fluid is discolored, for example by fruit pulp in the gateau. In conjunction with an upper suction unit, a contamination of the foodstuff by particles which are released as a result of cutting can furthermore also be avoided. For example, confectioner's sugar can be swirled up when cutting gateaux, said confectioner's sugar potentially settling at locations where this is visually undesirable. The upper suction device avoids this. The suction devices can simultaneously ensure that the environment of the processing region is free of precipitating foodstuff remains, this contributing toward an enhanced hygiene.

A further possibility for implementing a jet receptacle lies in that the latter, at a specific spacing from the processing region, has a slightly curved wall region. The liquid jet can then hug said wall region such that said liquid jet is deflected by way of the radius of the curvature of the wall region and can be converted to a trickle flow. The flow resistances associated therewith decelerate the liquid jet so that the liquid can subsequently be collected and either be disposed of or recycled.

Recycling of the liquid which is used for forming the liquid jet preferably includes filtering in order to remove material which does not emanate from the foodstuff and has potentially made its way into the liquid to be filtered out. Of course, the cutting waste of the foodstuff per se can also be filtered out here. Furthermore, the liquid in the meantime can also be heated or exposed to UV light for disinfecting.

The jet receptacle can also have further measures in order for the liquid jet to be additionally decelerated. A reverse flow nozzle which directs an airflow or else a liquid flow counter to the liquid jet is to be considered here, for example. The liquid jet is effectively decelerated on account thereof and expanded such that said liquid jet can be discharged without removed material. Flow directing profiles can also be used here, wherein said directing profiles can be protected against wear by way of a minor change in direction.

The jet receptacle per se in terms of the shape thereof is adapted to the concrete design embodiment of the cutting process. This relates in particular to the manner in which the foodstuff is moved relative to the liquid jet in order for the cut to be incorporated in the foodstuff. To this end, there are a plurality of alternative possibilities.

On the one hand, the foodstuff can be moved through a stationary liquid jet. The processing region in this case is configured such that the latter can move the foodstuff in a reciprocating manner in at least one direction and, potentially, can additionally also rotate said foodstuff. In the case of such an embodiment, either the processing region can be moved conjointly with the foodstuff relative to the liquid jet or the foodstuff is rotated and/or moved in a reciprocating manner relative to the processing region by a realignment device. In the first case, the jet passage opening can then be configured as an oval, rectangular, or a round opening since the jet passage opening in this case is locationally fixed in relation to the liquid jet. By contrast, in the second case the processing region is moved relative to the liquid jet such that the jet passage opening here in this instance is configured in the form of a slot, or of a long bore.

A further embodiment of the cutting procedure can have a liquid jet that is moved relative to the stationary processing region and relative to the stationary foodstuff. The jet passage opening in this case is also preferably configured in the form of a slot.

Of course, combinations of both movements of the foodstuff relative to the liquid jet can also be used, in that the foodstuff is moved either conjointly with the processing region, or relative to the processing region, on the one hand, and the liquid jet is moved, on the other hand.

The liquid jet in turn can be directed downward so as to be orthogonal to the advancing direction; however, angled approaches are also possible. Furthermore, the liquid jet, in particular in the case of deep-frozen foodstuffs, will not cut through the foodstuff in a completely straight manner, but will slightly migrate counter to the advancing direction. The spatial position of the jet passage opening therefore preferably takes said realignment into account. To this end, said jet passage opening, when viewed in the advancing direction, is disposed by the respective distance behind the upper impact point of the liquid jet on the upper side of the foodstuff.

Since the cutting devices are not always specially specified for a single type of foodstuff, either the position of the jet receptacle can be configured so as to be adjustable conjointly with the jet passage opening, or the exit nozzle of the liquid jet can be provided so as to be movable on the device in such a manner that said exit nozzle is mounted so as to be adjustable relative to the jet passage opening and relative to the jet receptacle in order for any jet migration as a result of the resistance of the material to be cut to be taken into account.

Depending on the characteristics of the foodstuff to be cut, the latter can be positioned on a workpiece support or else can be transported without such a workpiece support through the device by the advancing device. In the case of the use of a workpiece support, the foodstuff can be fixed on the workpiece support. Such fixing can be performed by way of clamping means or else peripheral delimitations between which the foodstuff is placed. The fixing mechanism can furthermore also be disposed as an external clamping means in the region of the processing region, said external clamping means fixing the foodstuff from the side, along a circumference, and/or from above, for example, shortly prior to the commencement of the cutting process. Of course, the workpiece support must likewise have a jet passage.

A typical application of the device is cutting gateaux, for example. Here the peculiarity now arises, for example, that gateaux often have different layers which in turn have dissimilar consistencies. For example, in addition to the baked dough layers, a cream layer, fruit or fruit pulp can thus be contained in the gateau. In particular when a white cream layer and a colored fruit pulp layer above the former are present, the temperature of the gateau, the advancing speed, and the jet pressure have to be optimized in such a manner that, for example, the red fruit pulp layer does not smear along the cutting edge and thus produces an unsightly result.

Therefore, a frozen cake, that is to say a cake colder than −10° C., in particular colder than minus 15° C., or deep-frozen in the context of food regulations, that is to say between −18° C. and preferably −25° C., is preferably cut. In addition to the advantage that the fruit pulp layer does not smear, this has the further advantage that the shape of the cake is stable and can be readily fixed. Furthermore, the cake pieces that are subsequently cut can be more easily separated from other cake pieces and, for example, can be assembled to form a mixed assortment. A commonplace application is indeed the assembly of assortments of different gateau pieces in one pack. To this end, the ready-made gateaux which are otherwise sold as whole gateaux are used. Said gateaux are then cut and sorted.

Cutting in the deep-frozen state additionally prevents the cake from having to be thawed again for cutting, this at present usually being the case when cutting by knives. Finished packaged cakes are usually delivered frozen. In order for the mixed assortment to be produced, in the case of conventional cutting methods by means of ultrasonically excited knives, this cake which after production has initially been frozen is again thawed for cutting and again frozen for sorting and shipping. However, in addition to the time required, this intermediate thawing can lead to losses in terms of quality. The latter are additionally avoided by way of the invention.

The deep-frozen gateau is cut at advancing speeds of 2 m/min, for example. A typical jet pressure of the liquid jet is 3500 bar; in as far as solids such as, for example, seeds of raspberries or strawberries, are located in the cake, a pressure of more than 5000 bar, preferably between 5500 bar and 6000 bar, can also be used.

A potential application of the device is the processing of cakes, as has already been described. However, it can also be applied to all other foodstuffs, in particular also to meat, fish, ready meals such as baguettes, tartes flambées or pizza or bakery items. In particular in the processing of foodstuffs having dissimilar thicknesses along the cutting line, the foodstuffs can either be preshaped prior to deep-freezing or the advancing speed can be adapted to the thickness such that the advancing is performed more rapidly in the case of a lesser thickness and more slowly in the case of a greater thickness.

The pre-shaping prior to deep-freezing has the further advantage that, in the case of foodstuffs which have a cavity, the latter prior to deep-freezing is compressed such that undesirable effects in the passing of the liquid jet through said cavity can be avoided. Such a problem arises, for example, when cutting calamari tubes. When said tubes are flattened and subsequently deep frozen, a homogeneous, double layer of calamari flesh results, which can be easily cut despite the rubbery elastic flesh that is relatively hard for a foodstuff.

The liquid which is used for cutting can be additionally cooled, for instance to a temperature of a few ° C., so as to minimize a thawing of the cutting peripheries. When using a liquid of which the freezing point is below 0° C., the temperature of the liquid can also be below 0° C. Additional abrasive particles can also be admixed, which of course have to be foodstuff-safe. Said particles can be, for example, sugar or salt crystals, or else edible pieces of foodstuffs, for example ground nuts or similar. Water, oil or a dispersion of water and oil, are preferably used as a liquid here.

SUMMARY OF THE DRAWINGS

Further features and advantages of the disclosure are derived from the following description of preferred exemplary embodiments by means of the drawings.

In the drawings:

FIG. 1 shows the processing region of a device for cutting foodstuffs;

FIG. 2 shows a potential embodiment of a jet receptacle having a lower suction device;

FIG. 3 shows a second embodiment of a jet receptacle;

FIG. 4 shows the processing region in a first embodiment, in top view;

FIG. 5 shows a design embodiment of a processing region, in top view;

DESCRIPTION

Figure 6:
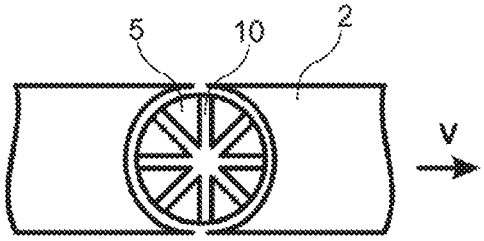
FIG. 6 shows a third embodiment of the processing region.

The significant region of a device for slicing foodstuffs 1 is illustrated in FIG. 1. An advancing device 2 which in the central region has a stationary processing region 5 is schematically illustrated here. The foodstuff 1 by way of the advancing device 2 is initially transported in the advancing direction V to the processing region 5 and then again away from the latter to further processing. A liquid jet 4 is directed onto the foodstuff 1 by way of an exit nozzle 3 in the processing region 5.

An upper suction device 8 by way of which splashing particles of the foodstuff 1 and also residual liquid can be suctioned is provided in the region of the lower end of the exit nozzle 3. A jet receptacle 6 and a lower suction device 7 are provided below the processing region 5, wherein particle residues and liquid components can likewise be suctioned by way of the lower suction device 7.

The jet receptacle 6 receives the liquid jet 4 exiting downward, such that the liquid can be collected and either be disposed of or recycled. The upper suction device 8 and the lower suction device 7, in addition to the enhanced cleanliness and the avoidance of contaminations on the foodstuff 1, have the advantage that a higher degree of foodstuff hygiene can be achieved.

A feature of the device illustrated here is the transport of the foodstuff 1 to the processing region 5 which is configured so as to be separate from the transport device. Since foodstuffs are usually rather soft, said foodstuffs, as opposed to rigid materials, can in most instances be cut by liquid jets 4 only when said foodstuffs bear on a support face. On the other hand, however, said support face has the disadvantage that the latter, when protruding into the liquid jet 4 by way of part regions, entails reflections of the cutting liquid and the removal of material. The latter would not only lead to wear on the support face, but also entail problems in the processing of foodstuffs, since the precipitation of particles which have been removed by the liquid jet 4 from the support face are of course undesirable on the foodstuff 1.

For the above-mentioned reason, the support face within the processing region 5 has at least one jet passage opening 10. As to how this jet passage opening 10 is configured depends substantially on the motion sequence by way of which the cut is made in the foodstuff 1. To this end, the foodstuff 1 is moved relative to the exit nozzle 3. This relative movement can be performed either by a movement of the foodstuff 1 or by a moving exit nozzle 3. Of course, a combination of both movements is also possible.

Typical movements of the foodstuff 1 and of the liquid jet 4 are illustrated in FIGS. 4, 5 and 6. A first possibility of handling the workpiece is schematically illustrated in FIG. 1 using the example of cutting a gateau. In the variant illustrated in FIG. 4, the deep-frozen gateau lying on the processing region 5 is moved by a realignment device 11 formed by a clamp having round jaws. Since the processing region 5 here is configured so as to be stationary, a simple bore in the processing region 5 is sufficient as the jet passage opening 10. Said bore will of course be larger than the diameter of the liquid jet 4 in order to avoid scatter effects. The dimension of the jet passage opening is larger than the jet diameter by a multiple, usually by at least 10 times.

The cake is rotated and displaced within the plane of the processing region 5 by way of the realignment device 11. The clamping jaws of the realignment device 11 here can engage below the cake so as to prevent the radial pressure being excessive, this being practical in particular when external decorations are located on the periphery of the cake. Alternatively, the processing region 5 can of course also be configured so as to be so large that the gateau can be displaced in the transverse direction without protruding laterally beyond said processing region.

The exit nozzle 3 can be configured so as to be repositionable also in the case of the embodiment described above. FIG. 5 shows a processing region 5 for this embodiment. The jet passage opening 10 here is configured so as to be slot-shaped, so that the exit nozzle 3 conjointly with the liquid jet 4 can be displaced in a reciprocal manner in the advancing direction V. In the case of this embodiment, a cut through the cake in a manner parallel to the advancing direction V is thus initially incorporated. The cake is thereafter rotated such that a further cut can be incorporated by way of the same movement, said cut being offset by the desired angle. This rotation can be performed either by a rotatable configuration of the processing region 5 or by way of a realignment device 11 as is illustrated in FIG. 4.

FIG. 6 shows a embodiment of the processing region 5 in which all cuts for slicing the cake can be produced exclusively by a movement of the exit nozzle 3, without any movement of the processing region 5.

Two potential embodiments of the lower jet receptacle 6 are illustrated in FIGS. 2 and 3. The jet receptacle 6 in FIG. 2 is configured so as to be tubular, having a slightly funnel-like upper inlet region. Said jet receptacle in the upper region has the lower suction device 7. The latter, in a manner directed upwardly, has a suction opening that surrounds the jet receptacle, through which particles and quantities of liquid that have been entrained downward by the liquid jet 4 can be suctioned. The lower suction device 7 can simultaneously also prevent a formation of droplets on the lower side of the jet passage opening 10.

The funnel of the jet receptacle 6 in the lower region is angled toward the rear and transitions into drain line. The liquid jet 4 hugs the external wall of the angled region and is deflected in a manner that is gentle on the material. In order for any erosion of the wall to be avoided, the funnel of the jet receptacle 6 can be configured in a correspondingly long manner such that the liquid jet 4 expands and the flow thus becomes slower. The diameter of the lower region of the funnel and of the drain line of course has to be adapted to the desired expansion.

In as far as the measures described above should not be sufficient for avoiding evidence of erosion, additional measures can be taken. FIG. 3 shows one possibility, for example. Here, a reverse flow nozzle 9, by way of which a gaseous medium, in particular air, can be blown counter to the liquid jet 4, is disposed within the inlet funnel of the jet receptacle 6. On account thereof, a build-up effect results for the flow of the liquid jet 4, said build-up effect expanding the jet still in the widened region of the inlet funnel of the jet receptacle 6. Additionally, a negative pressure can be brought to bear on the drain line, said negative pressure suctioning the liquid that is located in the jet receptacle 6 around the reverse flow nozzle 9. It goes without saying that the risk of any erosion is also to be minimized by way of a suitable choice of material in the case of all embodiments.

Alternatively to a reverse flow nozzle 9, readily replaceable flow directing profiles can also be provided in the jet receptacle 6. Said flow directing profiles can be configured, for example, so as to be mesh-shaped or else rod-shaped, so as to form a jet resistance that causes turbulences.

The use of the lower suction device 7 and/or of the upper suction device 8, in particular in conjunction with the jet receptacle 6, has the advantage that the noise emissions of the liquid cutting can be reduced such that complex noise-damping measures or closed cabinets can be dispensed with and the personnel operating the device has to wear hearing protection at most in the direct proximity of the device. The upper suction device 8 and the lower suction device 7, like the exit nozzle 3, can be mounted so as to be actuatable onto the foodstuff 1 such that the spacing from the foodstuff 1 can be minimized.

Figure 7:
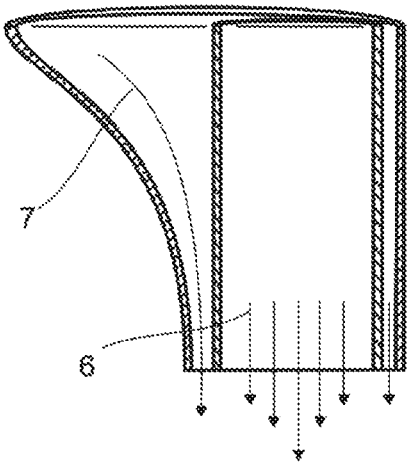
FIG. 7 shows a third potential embodiment of a jet receptacle and of a lower suction device.

An exemplary solution for the lower suction device 7 and the jet receptacle 6 is illustrated in FIG. 7. The jet receptacle 6 here is formed by a tubular member which is produced in a subtractive manner (for example by milling or honing) and which is composed of a metal. The jet receptacle 6 preferably has a smooth surface so as to avoid unfavorable flow effects which, for example, could cause erosion. Additionally, the internal side of the jet receptacle 6 can be polished or hardened. This is advantageous in particular in the upper region of the jet receptacle 6, while the lower regions according to experience can be formed by a normal metal tube, wherein the lower region can be considered, for example, to be the region which is disposed approximately 50 mm below the upper opening of the jet receptacle 6.

Figure 8:
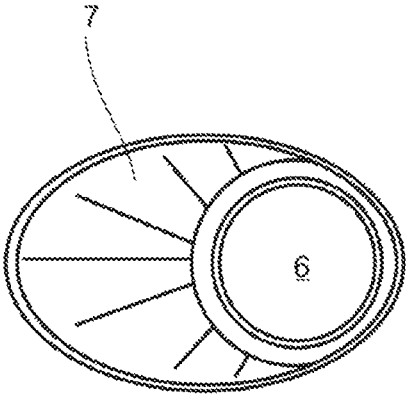
FIG. 8 shows a jet receptacle, or lower suction device, respectively, illustrated in FIG. 7, in top view.

The lower suction device 7 here in the upper region is configured so as to be oval, which can be seen in particular from the top view illustrated in FIG. 8. The jet receptacle 6 is provided in the front region of the oval region, since when viewed in the advancing direction, more particles from the foodstuff 1 will be located behind the impact point of the liquid jet 4 than in front of said impact point. This is amplified in that the liquid jet, as a result of the cutting resistance, will be set somewhat obliquely in particular in the case of frozen foodstuffs 1.

Figure 9:
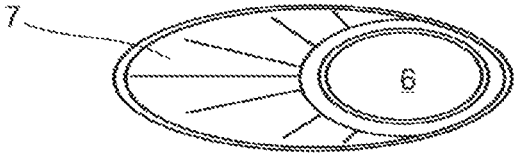
FIG. 9 shows a fourth embodiment of a jet receptacle and of a lower suction device.
Figure 10:
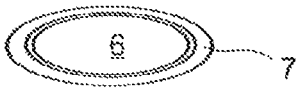
FIG. 10 shows a fifth embodiment of a jet receptacle and of a lower suction device.

FIG. 9 shows a further embodiment of the jet receptacle 6, which here in a manner transverse to the advancing direction is configured so as to be substantially narrower. This has the advantage that back-splashing of the liquid from the jet receptacle 6 can be reduced due to the tighter drain duct. FIG. 10 shows a similar embodiment, here however having a lower suction device 7 that is adapted to the shape of the jet receptacle 6.

Figure 11:
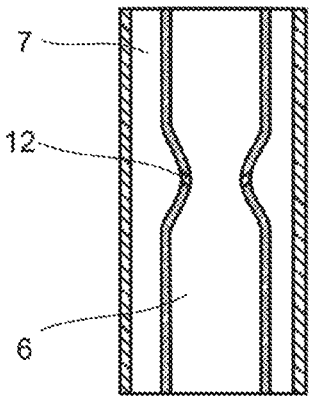
FIG. 11 shows a sixth embodiment of a jet receptacle and of a lower suction device, in a side sectional view.
Figure 12:
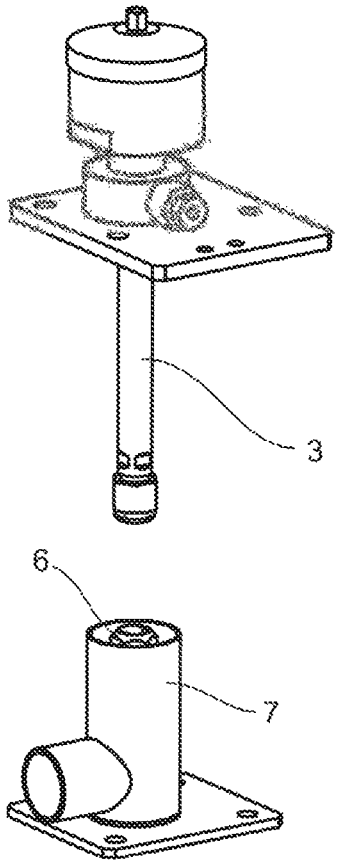
FIG. 12 shows an exit nozzle and a jet receptacle having a lower suction device of a further embodiment.

A further embodiment in which the jet receptacle 6 is likewise configured as a tube is illustrated in FIG. 11. However, said jet receptacle here has a constriction in order for a flow-accelerating nozzle to be formed. The pressure in the region of this constriction is reduced as a result of the flow as compared to the lower suction device, wherein by way of suction openings 12 in the constricted region which short-circuit the two pressure regions, a suction effect is created on account of the negative pressure in the jet receptacle 6, without a pump being required.

Figure 13:
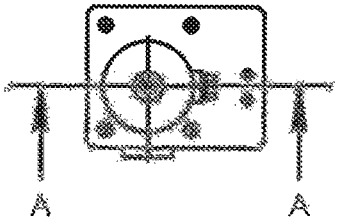
FIG. 13 shows the design embodiment as per FIG. 12 in top view.
Figure 14:
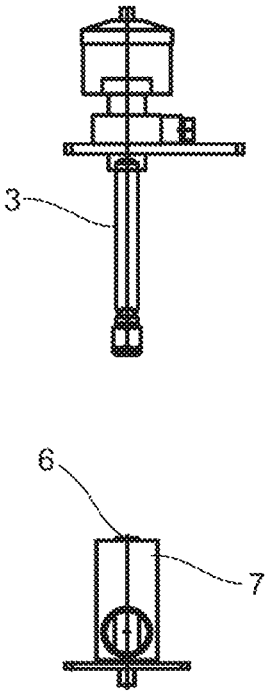
FIG. 14 shows the embodiment as per FIG. 12 in a side view.
Figure 15:
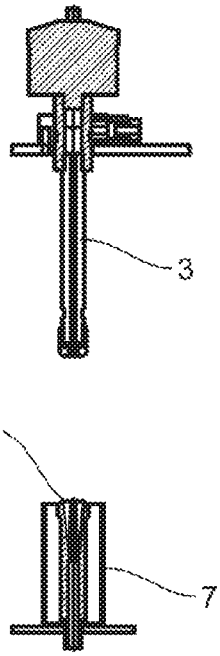
FIG. 15 shows the section A-A from FIG. 13.
Figure 17:
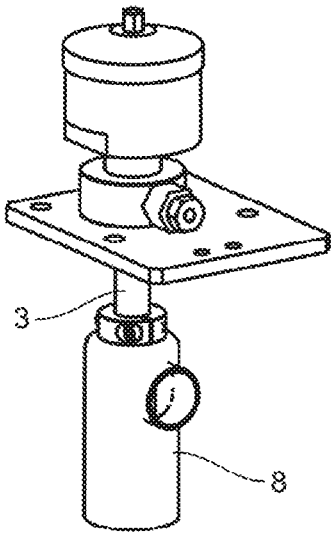
FIG. 17 shows the design embodiment as per FIG. 16 in top view.
Figure 17:
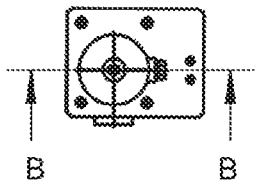
Figure 16:
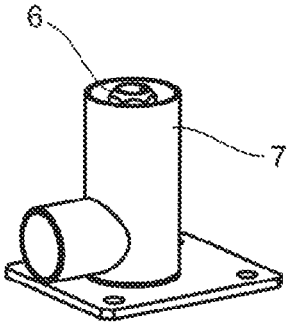
FIG. 16 shows an exit nozzle having an upper suction device and a jet receptacle having a lower suction device, of the last embodiment.
Figure 18:
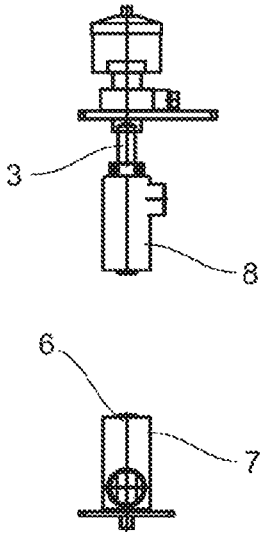
FIG. 18 shows the design embodiment as per FIG. 16 in a side view.
Figure 19:
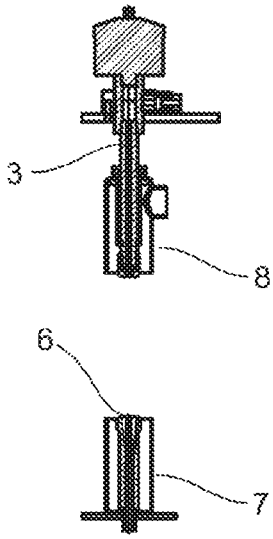
FIG. 19 shows the section B-B from FIG. 17.

An exemplary embodiment of the significant functional parts of the device is illustrated in FIGS. 12 to 15. The jet receptacle 6, surrounded by a lower suction device 7, can be seen here in the lower part. The upper part of the device has the exit nozzle 3 by way of which the liquid jet 4 is directed onto the processing region 5 (not illustrated here). FIG. 13 shows said device from above; a side view is illustrated in FIG. 14. FIG. 15 in turn shows the section A-A from FIG. 13.

A very similar device which in the lower region does not differ from the embodiment illustrated in FIGS. 12 to 15 is illustrated in FIGS. 16 to 19. However, an upper suction device is provided here in the upper region, said upper suction device being able to suction particles and liquid mist also above the foodstuff 1. This has the advantage, for example, that swirled-up confectioner's sugar, reflected cutting fluid or similar particles can be suctioned, and thus cannot contaminate the foodstuff 1 or smear the surface, respectively, or cause other unfavorable effects.

The upper part of the device having the exit nozzle 3 and, if present, the upper suction device 8 can be configured so as to be height-adjustable, wherein the device can have a height sensor which can automatically set the spacing of the exit nozzle 3 from the foodstuff 1. On account thereof, it can be avoided that the spacing between the exit nozzle 3 and the foodstuff 1 becomes excessive.

LIST OF REFERENCE SIGNS

1 Foodstuff
2 Advancing device
3 Exit nozzle
4 Liquid jet
5 Processing region
6 Jet receptacle
7 Lower suction device
8 Upper suction device
9 Reverse flow nozzle
10 Jet passage opening
11 Realignment device
12 Suction opening
V Advancing direction

The invention claimed is:

1. A device for slicing foodstuffs by means of at least one liquid jet, comprising:

an advancing device for transporting the foodstuff in at least one advancing direction through the device, said advancing device having a processing region on which the foodstuff to be sliced is borne and in which the liquid jet is directed onto the foodstuff;

at least one exit nozzle, disposed in the region of the processing region, from which a pressurized, bundled liquid jet exits, wherein the processing region below the foodstuff has a jet passage opening for the liquid jet exiting from the foodstuff and a jet receptacle into which the liquid jet enters in order for the cutting liquid to be collected, and which has a discharge for the cutting liquid;

wherein the jet receptacle is disposed below the jet passage opening and includes a funnel-like upper inlet region descending to a tubular portion, wherein the upper inlet region has a lower suction device for at least one of particles entrained by the liquid jet, and liquid, which accumulate on the jet passage opening or are separated from the liquid jet;

wherein the lower suction device is formed by an annular suction duct in which the jet receptacle is disposed such that a suction gap is provided annularly about the jet receptacle, through which the at least one of particles entrained by the liquid jet and liquid are capable of being suctioned;

wherein the lower suction device includes an upwardly directed suction opening that surrounds the jet receptacle and through which particles and liquid that have been entrained downward by the liquid jet can be suctioned.

2. The device of claim 1, wherein at least the upper inlet region of the jet receptacle has an oval cross section, wherein the jet receptacle is oriented in such a manner that it is wider in the advancing direction than in a perpendicular direction to the advancing direction.

3. The device of claim 1, wherein at least the upper inlet region of the jet receptacle has a teardrop-type cross section having a semicircular front region, a center of the upper inlet region being disposed below the jet passage opening, and a rear region of the cross-section converging in a direction counter to the advancing direction.

4. The device of claim 1, wherein an upper suction device which is capable of suctioning liquid or particles that splash back from the foodstuff is provided above the processing region.

5. The device of claim 4, wherein the upper suction device has an annular nozzle having a passage opening disposed in the central region, the liquid jet being routed through said passage opening, wherein suction openings are provided on the lower side of the annular nozzle.

6. The device of claim 1, wherein the jet receptacle, has, in a side wall, suction openings for forming a venturi nozzle, said suction openings being distributed across a circumference and being capable of generating a negative pressure in the suction duct for forming the lower suction device.

7. The device of claim 6, wherein the jet receptacle, when viewed from the processing region, has a cross section that initially decreases and then increases again, wherein the suction openings are disposed in the decreased cross-sectional region.

8. The device of claim 1, wherein the device has a jet expansion device for the liquid jet, said jet expansion device being disposed in the jet receptacle and being capable of at least one of widening and decelerating the liquid jet passing through the jet passage opening.

9. The device of claim 8, wherein the jet expansion device is formed by at least one reverse flow nozzle which is disposed in the jet receptacle and is capable of directing a fluid flow counter to the liquid jet.

10. The device of claim 8, wherein the jet passage opening is configured in as a slot having one or a plurality of elongate bores that are mutually disposed at an angle so as to intersect.

11. The device of claim 1, wherein the advancing device is capable of moving the foodstuff in a cycled manner into the processing region, wherein the advancing device is configured in such a manner that the foodstuff after having been moved into the processing region is locationally fixed during cutting or is movable only within the processing region.

12. The device of claim 11, wherein the device has a realignment device which is capable of gripping the foodstuff to displace or rotate the foodstuff in the processing region.

13. The device of claim 11, wherein the exit nozzle and the jet receptacle are repositionable relative to the foodstuff in at least one of the advancing direction and at an angle in relation to the advancing direction.

14. The device of claim 11, wherein the exit nozzle is configured so as to be stationary.

15. The device of claim 1, wherein the device for generating the liquid jet is configured in such a manner that said device uses a pressure of at least 3500 bar, wherein the device is configured in such a manner that said device is capable of operating using at least one of different jet diameters and different pressures of the liquid jet.

* * * * *